US010202697B1

(12) United States Patent
Carpenter

(10) Patent No.: US 10,202,697 B1
(45) Date of Patent: Feb. 12, 2019

(54) CHLORINE GENERATING SYSTEM

(71) Applicant: Steve Carpenter, Shawnee, KS (US)

(72) Inventor: Steve Carpenter, Shawnee, KS (US)

( * ) Notice: Subject to any disclaimer, the term of this patent is extended or adjusted under 35 U.S.C. 154(b) by 538 days.

(21) Appl. No.: 14/572,226

(22) Filed: Dec. 16, 2014

Related U.S. Application Data

(60) Provisional application No. 61/916,656, filed on Dec. 16, 2013.

(51) Int. Cl.

| | |
|---|---|
| ***C25B 1/26*** | (2006.01) |
| ***C25B 9/06*** | (2006.01) |
| ***C25B 9/20*** | (2006.01) |
| ***C25B 11/02*** | (2006.01) |
| ***C25B 11/03*** | (2006.01) |

(52) U.S. Cl.
CPC ..... *C25B 1/26* (2013.01); *C25B 9/06* (2013.01); *C25B 9/20* (2013.01); *C25B 11/02* (2013.01); *C25B 11/03* (2013.01)

(58) Field of Classification Search
CPC ..... C25B 1/26; C25B 9/06; C25B 1/06–1/08; C25B 9/20; C25B 11/02–11/03
See application file for complete search history.

(56) References Cited

U.S. PATENT DOCUMENTS

| | | | | |
|---|---|---|---|---|
| 4,108,756 | A * | 8/1978 | de Nora | C02F 1/46109 204/268 |
| 2013/0105307 | A1* | 5/2013 | Pavlovic | C25B 11/02 204/262 |
| 2013/0220240 | A1* | 8/2013 | Jonson | C25B 15/08 123/3 |
| 2013/0341201 | A1* | 12/2013 | McCormick | C25B 15/02 205/345 |
| 2014/0014529 | A1* | 1/2014 | Hinatsu | C25B 1/10 205/628 |
| 2014/0367272 | A1* | 12/2014 | Haywood | C25B 15/08 205/341 |
| 2016/0090657 | A1* | 3/2016 | Nigel | C25B 11/02 205/638 |

* cited by examiner

*Primary Examiner* — Nicholas A Smith
(74) *Attorney, Agent, or Firm* — Polsinelli PC

(57) ABSTRACT

A chlorine generating cell and method of use are provided. The chlorine generating cell generally comprises one or more anode plates, one or more cathode plates, and one or more gaskets. The anode and cathode plates have a unique design allowing gas that builds up within the cell to escape, making the chlorine cell of the present invention safe.

17 Claims, 10 Drawing Sheets

CHLORINE GENERATING SYSTEM

FIELD OF INVENTION

The invention relates generally to chlorine generating systems for generating chlorine from a brine solution. A chlorine generating cell is provided that comprises a plurality of plates for generating chlorine while preventing the accumulation of highly reactive gases.

BACKGROUND OF INVENTION

Generally, chlorine is manufactured by electrolysis of a sodium chloride solution. These chlorine generating systems produce chlorine that can be used as a disinfectant for industrial purposes or for chlorination of pools. The production of chlorine results in the co-products caustic soda (sodium hydroxide, NaOH) and hydrogen gas ($H_2$), which are highly reactive. As chlorine is generated in the system these gases can build up and cause major problems, such as extreme temperatures which can cause deterioration of the equipment to explosions.

What is needed in the art is a chlorine generating system that provides an appropriate yield of chlorine while mitigating some of the risk associated with such systems, such as extreme temperatures and possible explosions from gas build up within the system.

SUMMARY OF INVENTION

The invention generally provides for a chlorine generating cell, a series of plates used in the chlorine generating system, and a method of using the chlorine generating cell. The chlorine generating cell generally comprises a plurality of plates having a uniquely designed shape to receive a salt solution and produce chlorine, where the chlorine generating cell allows gas created within the cell to exit. Advantageously, the chlorine generating cell of the present invention provides an outlet for gas created within the cell, preventing extremely high temperatures within the cell and reducing, if not eliminating the possibility of explosions resulting from gas build-up within the cell.

The plate preferably has a generally round shape selected from the group consisting of a circle, oval, or ellipses. The plate preferably comprises a production area, a tab area, a means for receiving a power source, and one or more cut-out portions shaped such that they have a top apex, where the apex is in the center of the shape. Preferably, the one or more portions shaped such that they have a top apex where the apex is in the center of the shape are preferably provided on the plate as mirror images of the same shape of the same size, such that a first portion has the apex on the top of the shape and the second portion has the apex on the bottom of the shape. The plate of the present invention is also capable of receiving a charge, preferably from an electric source. The plate can be utilized as an anode plate or a cathode plate, depending on where it will be used in a chlorine generating cell of the present invention.

The chlorine generating cell of the present invention preferably includes one or more plates of the present invention. The system preferably includes 3, 5, 7, or 9 plates; however, larger odd numbers of plates are envisioned. In a system where more than one plate is used, the total number of plates must be used in an odd number such that an anode plate and a cathode plate can be placed sequentially with a cathode plate on each end of the assembly. Preferably, the placement of the plates within the cell provides a positive transference of electrical current between adjacent plates. This positive current initiates a chemical reaction changing the salt in the brine solution into a solution of free chlorine. Preferably, a tank for the brine is attached to the inlet of the chlorine generating cell and a Product tank is attached to the outlet of the chlorine generating cell. Preferably, the brine solution enters the cell assembly into the plenum area, and then rises upwards to the production area. In the production area, a chemical reaction occurs changing the brine solution to a solution of free chlorine. The solution then rises to the top of the upper plenum and exits the cell at the outlet and into the Product tank. Since all the production area is above the plenum, the shape of the plenum can establish even, uniform flow across the surfaces of the plates within the cell, thus eliminating any areas that might be subject to inadequate flow, causing "hot spots" and resulting in the deformation of plates. The plates are placed such that the chlorine generating cell does not have a cathode plate placed next to another cathode plate or an anode plate placed next to an anode plate.

In one embodiment, the chlorine generating cell of the present invention includes 3 plates of the present invention, 2 end plates, and a means for connecting a power source. The end plates are preferably arranged such that there is a first end section having at least one inlet, or an inlet end plate, on one side of the chlorine generating cell and a second end plate having at least one outlet, or an outlet end plate on the opposite side of the chlorine generating cell. The end plates are preferably shaped similar to the shape of the PVC is a preferred material for the inlet end plate and the outlet end plate; however, other materials that do not conduct electricity are envisioned, such as, but not limited to CPVC.

A method for using the chlorine generating cell of the present invention is also provided. Preferably, the method comprises the steps of placing 3 plates in succession, with the first and third plate being cathode plates and the second plate being an anode plate. Preferably, the method additionally includes the steps of attaching a power source to the plate, and running a salt solution or brine through the chlorine generating cell.

A method for generating chlorine utilizing the chlorine generating cell of the present invention is also provided. The method preferably includes the steps of running a brine solution through the chlorine generating cell of the present invention. Preferably, the method produces about 9,000 to 38,000 ppm/in$^2$/day/gal. Chlorine, depending on the concentration of salt in the brine solution. The concentration of salt in the brine solution is preferably about 2% to about 15%, with the most preferred value being 13% or less. The preferred amount of chlorine production per day can be found in Example 1.

DETAILED DESCRIPTION

The invention generally provides for a chlorine generating cell, an anode plate, a cathode plate, a series of plates used in the chlorine generating system, and a method of using the chlorine generating cell. The chlorine generating cell generally comprises a plurality of plates, where some are anode plates and some are cathode plates, having a uniquely designed shape to receive a brine solution and produce chlorine, where the chlorine generating cell allows gas created within the cell to exit. Advantageously, the chlorine generating cell of the present invention provides a plenum at which gas created within the chlorine generating cell collects and exits the cell, preventing extremely high temperatures within the cell and reducing, if not eliminating the possibility of explosions resulting from gas build-up within the cell. The plenum area of the cell plates also provides for an even, uniform flow of the brine solution across the surfaces of the anode and cathode plates, which eliminates any areas that might be subjected to inadequate flow, causing extreme temperatures or "hot spots" and resulting in the deformation of plates or possibly an explosive reaction of gas. A further advantage of the inlet plenum area and the solution rising up uniformly in between the cell plates is that solution enters the cell assembly below the production area, then rises vertically into the production area. The solution is preferably not injected directly across the edge of the production area. When a solution flows across an edge, a low pressure zone is formed on the back side of the edge where small particulate can be drawn to. This small particulate that builds up as additional scale contributes to uneven cooling and can provide an opportunity for plate distortion. The cell plate design of the present invention minimizes this effect due to the unique design features of the anode and cathode plates.

Figure 1:
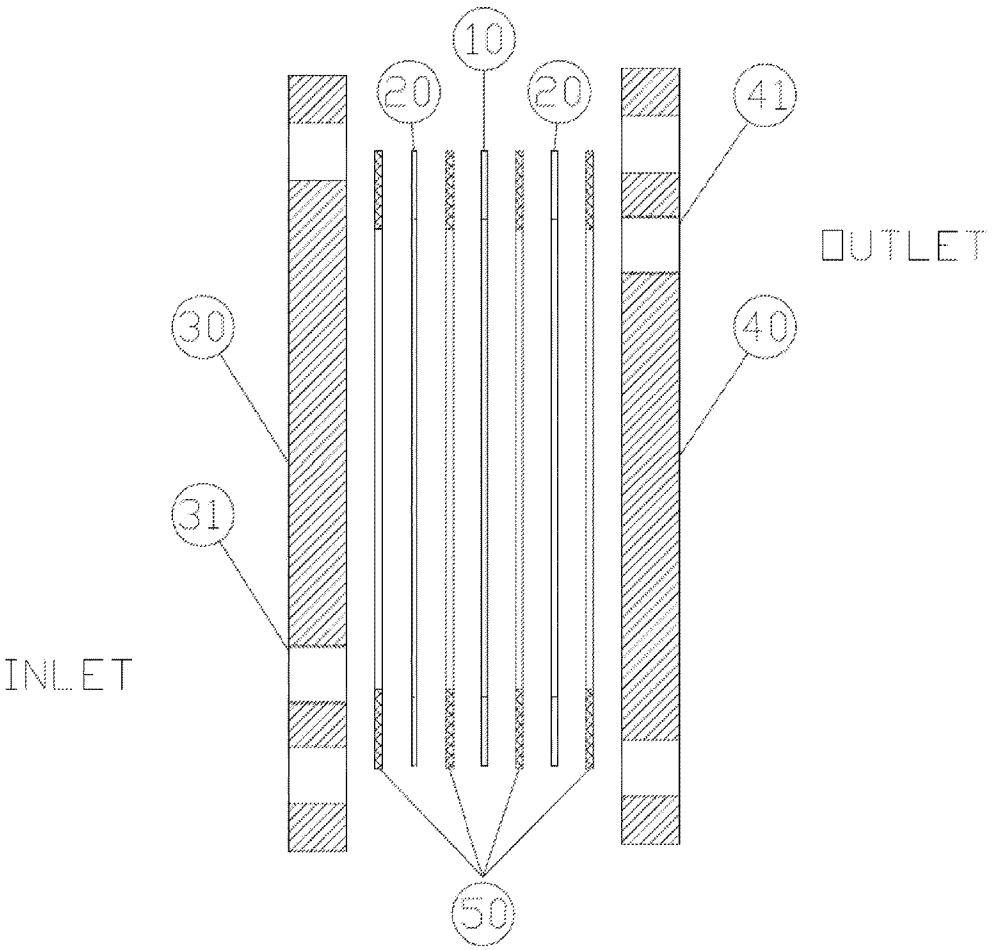
FIG. 1 is a side view of the chlorine generating cell.

The chlorine generating cell 1 of the present invention preferably includes at least 3 plates, wherein the plates are arranged with an anode plate 10 and a cathode plate 20 next to one another in the chlorine generating cell 1, such that there is not an anode plate 10 next to another anode plate 10 or a cathode plate 20 next to another cathode plate 20. This is illustrated in FIG. 1. In a preferred embodiment, where the chlorine generating cell 1 has 3 plates, 2 of the plates are cathode plates 20 and one of the plates are anode plates 10. The chlorine generating cell 1 of the present invention may comprise any odd number of plates, including, but not limited to, 3 plates, 5 plates, 7 plates, and 9 plates.

Figure 3:
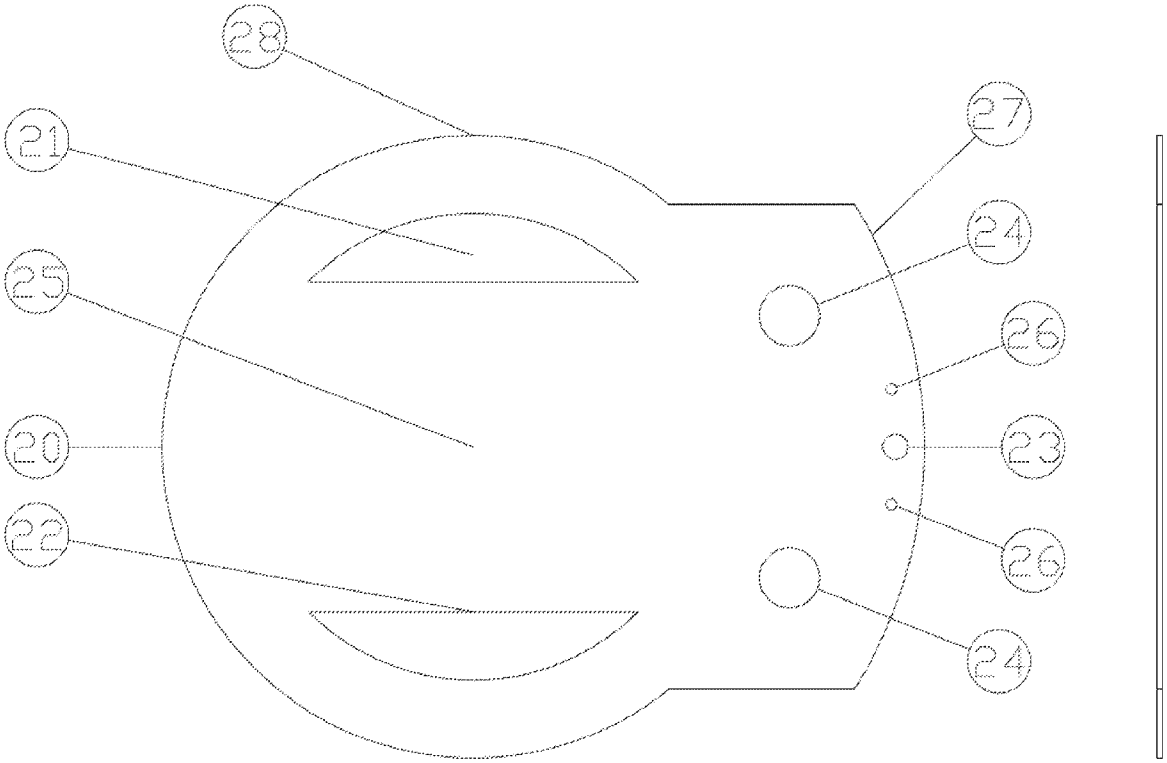
FIG. 3 is a plan view and a side view of the cathode plate of the present invention.
Figure 4:
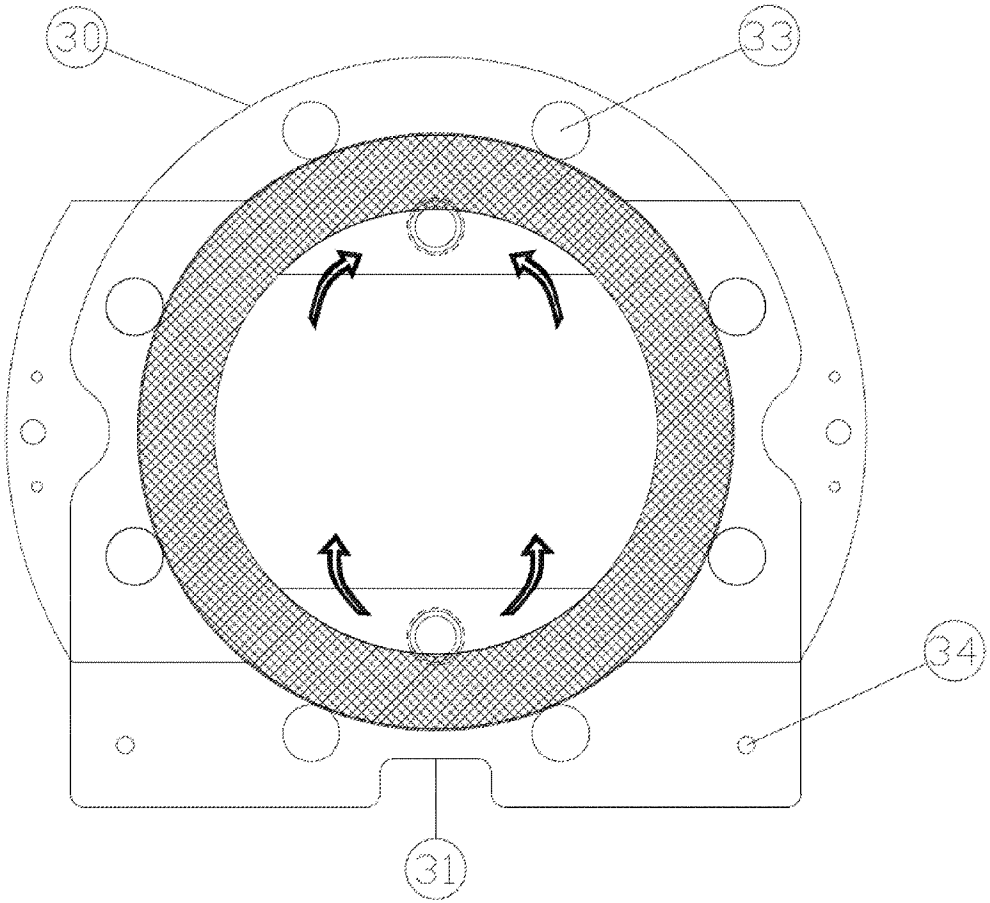
FIG. 4 is a side view of an end plate, gasket, anode plate, and cathode plate as in the chlorine generating cell of the present invention.

The cathode plate 20 of the present invention, illustrated in FIG. 3, is preferably generally round with a tab extending therefrom. The cathode plate 20 preferably comprises a plurality of shaped cut-outs, and where it is most preferred that there are two shaped cut-outs. The shaped cut-outs can be any shape that allows for the solution and/or gas created within the cell to exit at the apex of a shape. Preferred shapes for the shaped cut-outs include, but are not limited to, a circle, ellipses, oval, crescent, or any shape having a partial circle, ellipses, oval or crescent as part of its overall shape. In a preferred embodiment, the shaped cut-outs are aligned as mirror-images on the plate when viewed from the vertical center axis The shaped cut-outs 21 preferably are cut out of the cathode plate 20, such that they leave voids in the cathode plate 20. The voids allow the brine solution to flow through the chlorine generating cell 1 and across the cathode 20 and anode 10 plates in a uniform manner. The cathode plate 20 preferably comprises a tab portion 22 which extends from the rounded portion 28 of the cathode plate 20. The tab portion 22 preferably has one or more apertures for connecting a power source 23 and one or more apertures for connecting a sensor 26, which are all located on the rounded end 27 of the tab portion 22. The tab portion 22 further comprises one or more additional apertures 24 for connecting the cathode plate 20 to the chlorine generating cell 1. The cathode plate 20 preferably also comprises a production area 25.

Figure 2:
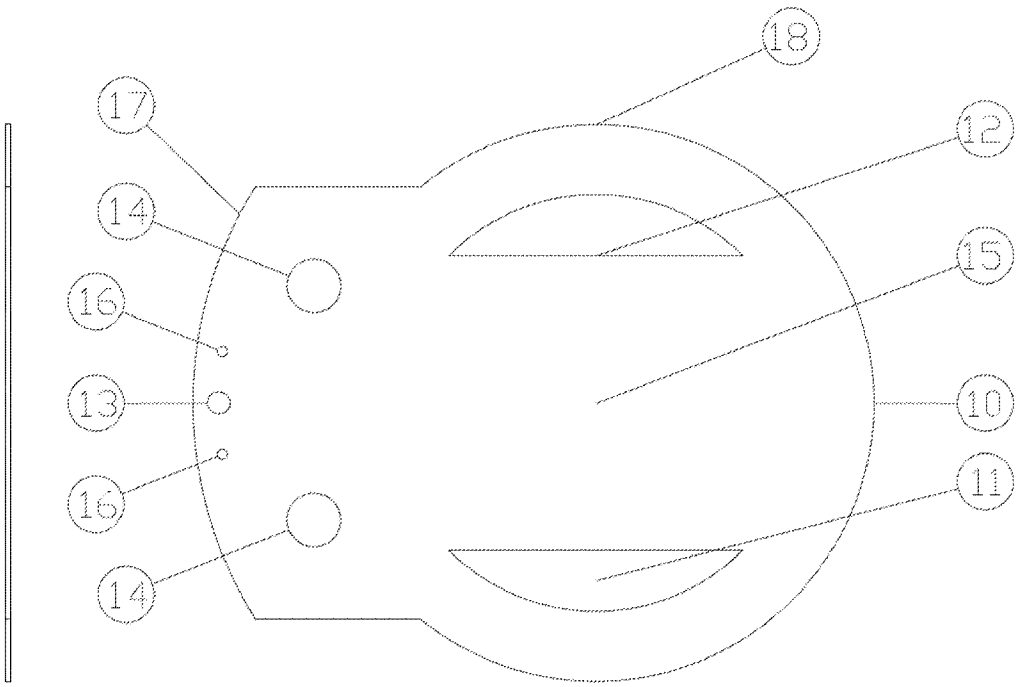
FIG. 2 is a plan view and a side view of an anode plate of the present invention.

The anode plate 10 of the present invention, as illustrated in FIG. 2, is preferably a round plate with a tab extending therefrom. The anode plate 10 preferably comprises a plurality of shaped cut-outs, where in a preferred embodiment; there is a first shaped cut-out 11 on the top of the anode plate 10 and a second shaped cut-out 11 on the bottom of the anode plate 10. The shaped cut-outs can be any shape that allows for the solution and/or gas created within the cell to exit at the apex of a shape. Preferred shapes for the shaped cut-outs include, but are not limited to, a circle, ellipses, oval, crescent, or any shape having a circle, ellipses, oval or crescent as part of its overall shape. The shaped cut-outs 11 are preferably cut out of the matrix of the anode plate 10, such that they leave voids in the anode plate 10. The voids allow the brine solution to flow through the chlorine generating cell 1 and across the cathode 20 and anode 10 plates in a uniform manner. The anode plate 10 preferably comprises a tab portion 12 which extends from the rounded portion 17 of the anode plate 10. The tab portion 12 preferably has one or more apertures for connecting a power source 13 and one or more apertures for connecting a sensor 16, which are all located on the rounded end 17 of the tab portion 12. The tab portion 12 preferably comprises one or more additional apertures 14 for connecting the anode plate 10 to the chlorine generating cell 1. The anode plate 10 preferably also comprises a production area 15, over which the brine solution pass creating chlorine.

The bottom shaped cut-outs provide a plenum where the brine solution can enter and flow evenly up between all the plates. The upper shaped cut-out allows a space where the gasses can collect, away from the production area of the plates and then leave through the outlet with the solution. The flat side of the shaped cut-out boarders the production area so that that solution flowing between the plates does so evenly and equally producing even heat removal from each plate. Consistent heat removal minimizes the potential dangerous condition of distorting the plates by localized thermal expansion. The inlet and outlet from the cell assembly are located at the apex of the shaped cut-out so the entering solution will experience a minimal low pressure effect on the downstream side of the plates where water deposits are likely to collect. The location of the outlet allows the gasses to fully exit the production area of the cell and travel upwards to the highest point in the assembly to be completely carried out.

In a preferred embodiment, both the anode plate 10 and cathode plate 20 are made of titanium; however other materials could also be used. Preferably, the anode plate is additionally coated with a precious metal coating upon which chlorine is generated.

Figure 7:
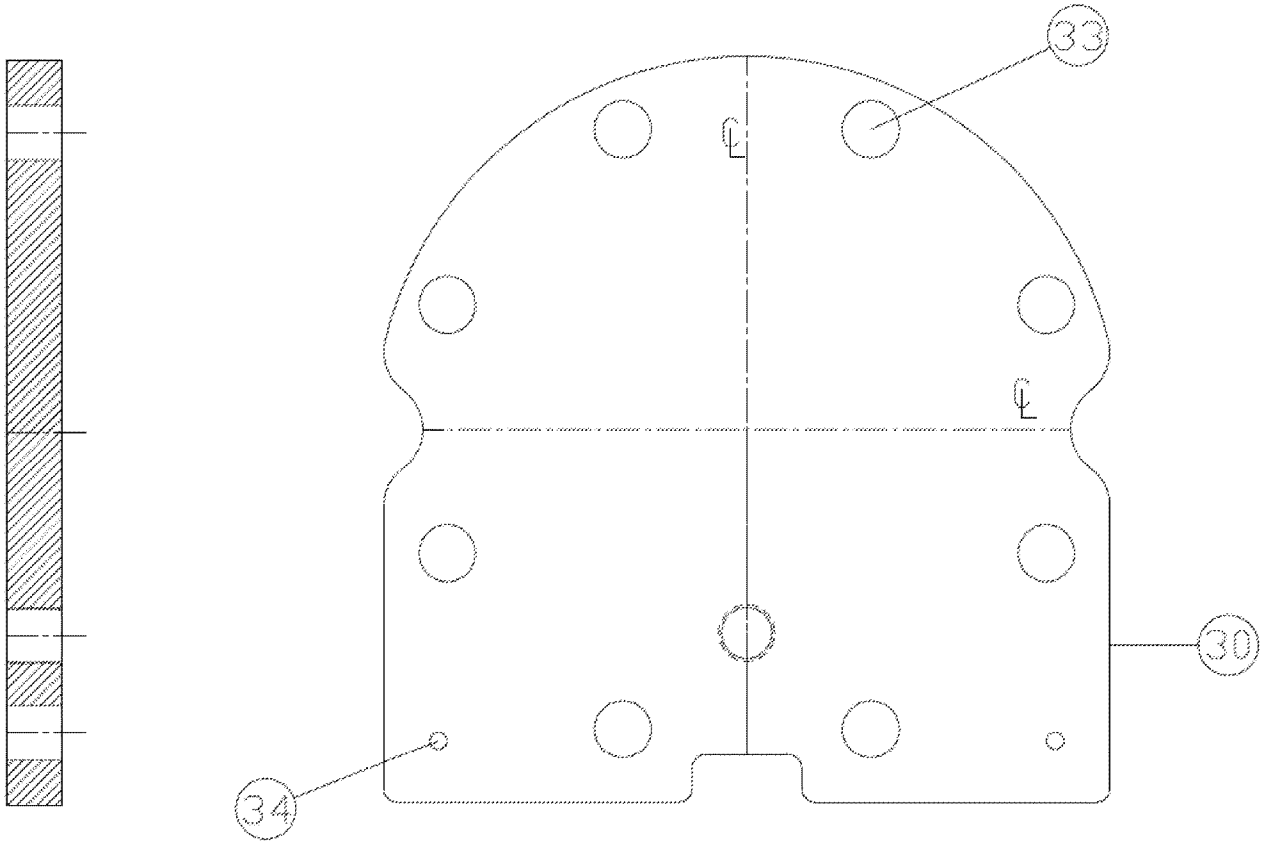
FIG. 7 is a plan view and a side view of the inlet end plate of the present invention.
Figure 8:
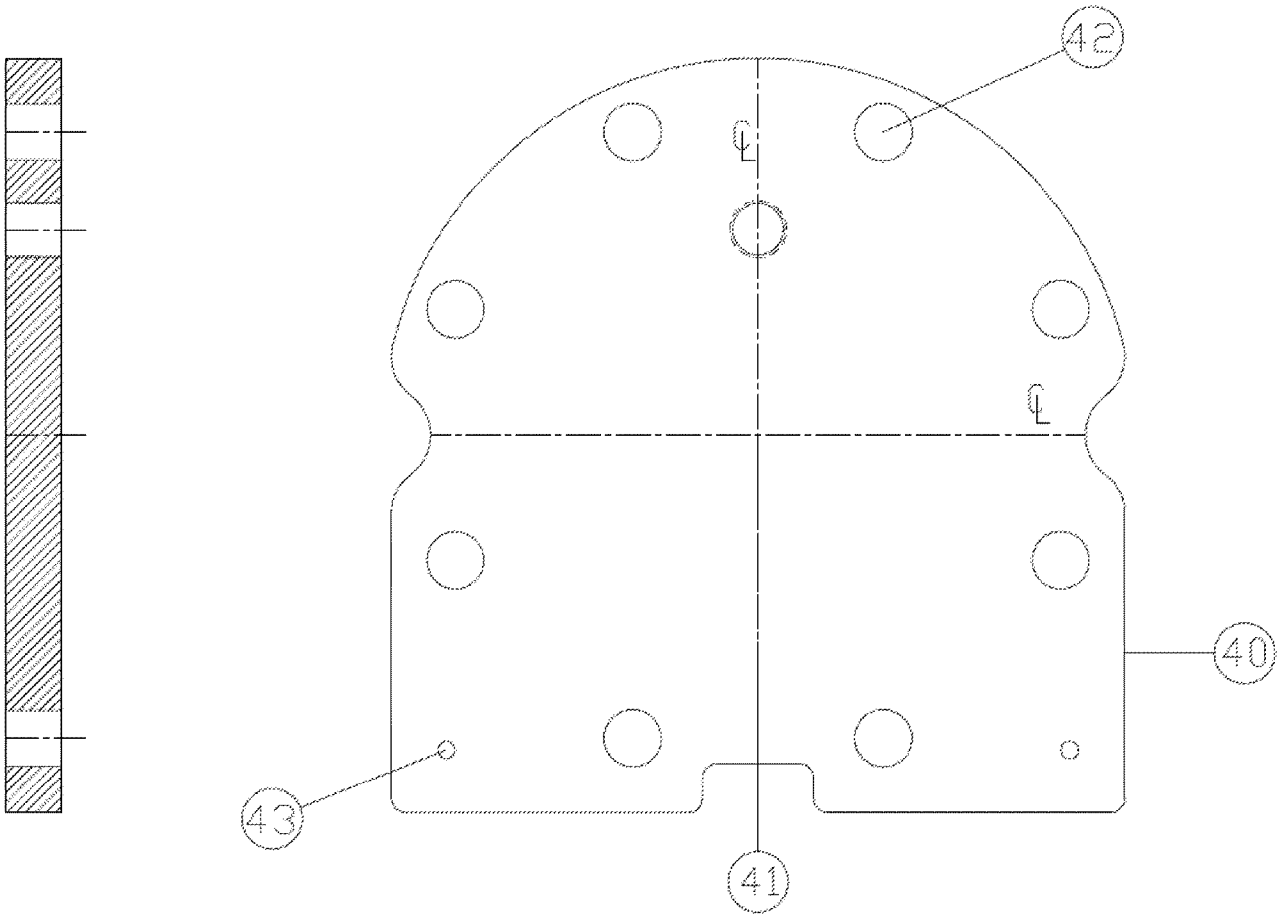
FIG. 8 is a plan view and a side view of the outlet end plate of the present invention.

The chlorine generating cell 1 of the present invention preferably comprises at least two end plates, where there is an inlet end plate 30 and an outlet end plate 40. The inlet end plate 30, illustrated in FIG. 7, preferably comprises one or more inlets and the outlet end plate 40, illustrated in FIG. 8, preferably comprises one or more outlets. The inlet end plate 30 has an inlet 31 for receiving the brine solution and other liquids which may run through the chlorine generating cell 1. The inlet end plate 30 also has a plurality of apertures 33 for connecting to the chlorine generating cell 1 and its components, such as the brine tank or Product tank. The inlet end plate 30 preferably has additional apertures for sensors 34. The inlet 31 preferably sits at the apex of the bottom shaped cut-out 21 of the anode plate, preventing any build-up or scale-up from forming and allowing the brine solution to directly enter the chlorine generating cell 1. Preferably, the end plates of the present invention are preferably made of PVC or another non-conductive material, such as, but not limited to CPVC.

The outlet end plate 40 preferably has an outlet 41 for the brine solution as it exits the chlorine generating cell 1 after being converted to chlorine. The outlet 41 preferably lines up with the apex of the top shaped cut-out of the last cathode plate 20, such that the chlorine solution exits the system without any build-up, scale-up, or accumulation of gas from the chlorine generating cell 1. The outlet end plate 40 preferably has one or more apertures 42 for connecting to the chlorine generating system 1. Preferably, the outlet end plate 40 additionally has one or more apertures for connecting a sensor 43.

Figure 6:
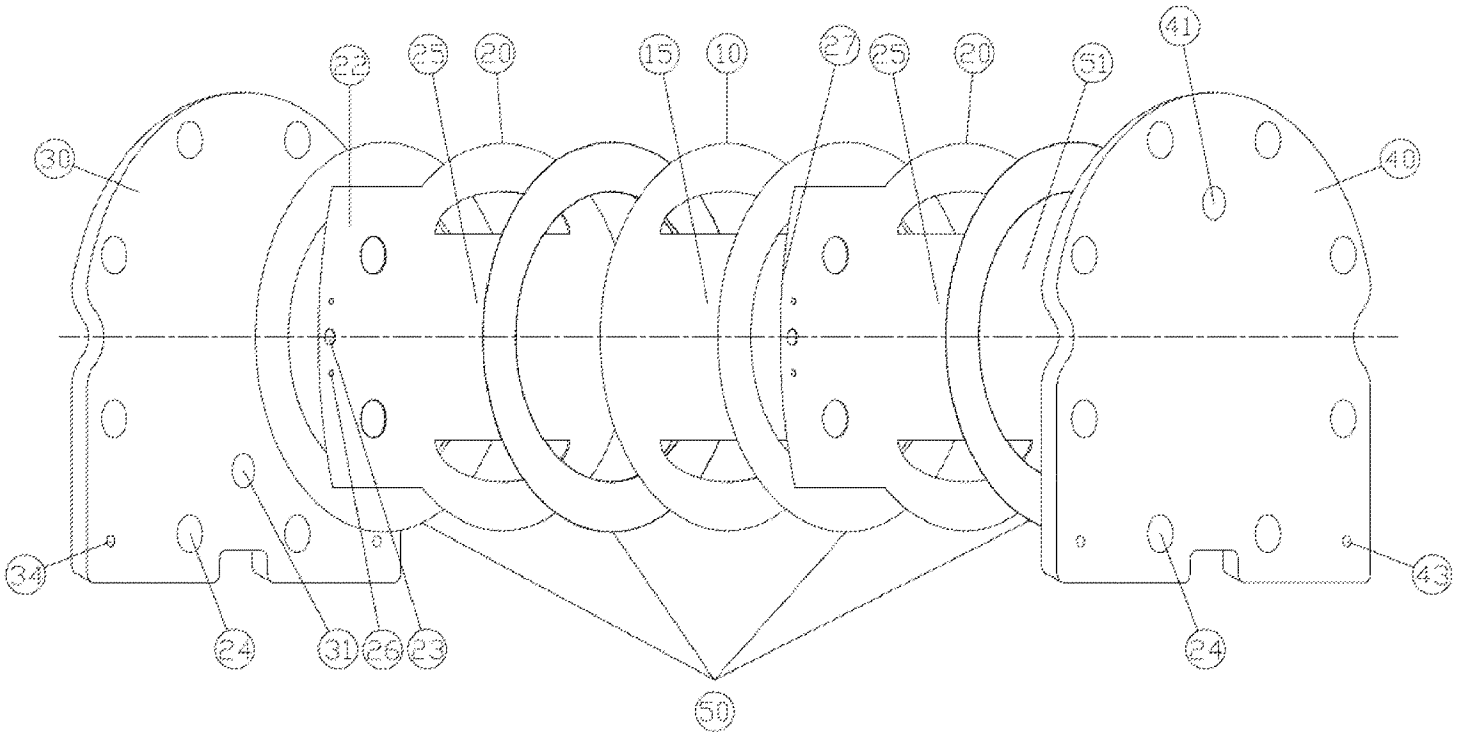
FIG. 6 is an exploded view of the chlorine generating cell of the present invention.

In an embodiment where three plates are utilized, generally, the chlorine generating cell 1 comprises, in this order, an inlet end plate 30, a gasket 50, a cathode plate 20, a gasket 50, an anode plate 10, a gasket 50, a second cathode plate 20, a gasket 50, and an outlet end plate 40. This is illustrated in FIGS. 1 and 6. Preferably, the tab portion 22 of the cathode plates 20 are oriented facing opposite of the tab portion 12 of the anode plate 10 within the chlorine generating cell 1. The inlet 34 of the inlet end plate 30 preferably allows brine solution to flow through the shaped cut-out portions 21 of the cathode plates 20 and the shaped cut-out portions 11 of the anode plate 10, such that the chlorine solution exits the chlorine generating cell 1 at the apex of the shaped cut-out portion 21 of the last cathode plate 20 in the system. Allowing the chlorine solution to exit at this point allows for all of the gas created within the system to exit, avoiding the problem of accumulation of gas within the system, leading to potential dangerous high temperatures within the system and/or an explosion of the highly reactive gas. Preferably, the gasket shape is dependent upon the shaped-cut out portion of the plate. The gasket preferably runs right along the edge of the shaped cut-out portion along the apex of the top shaped cut-out portion and the apex of the bottom shaped cu-out portion defining the production area therein. It is preferred that there is no overlap of the gasket such that a portion of the gasket would extend beyond the shaped-cut out into the void, as this overlap could provide for accumulation and build-up.

Figure 5:
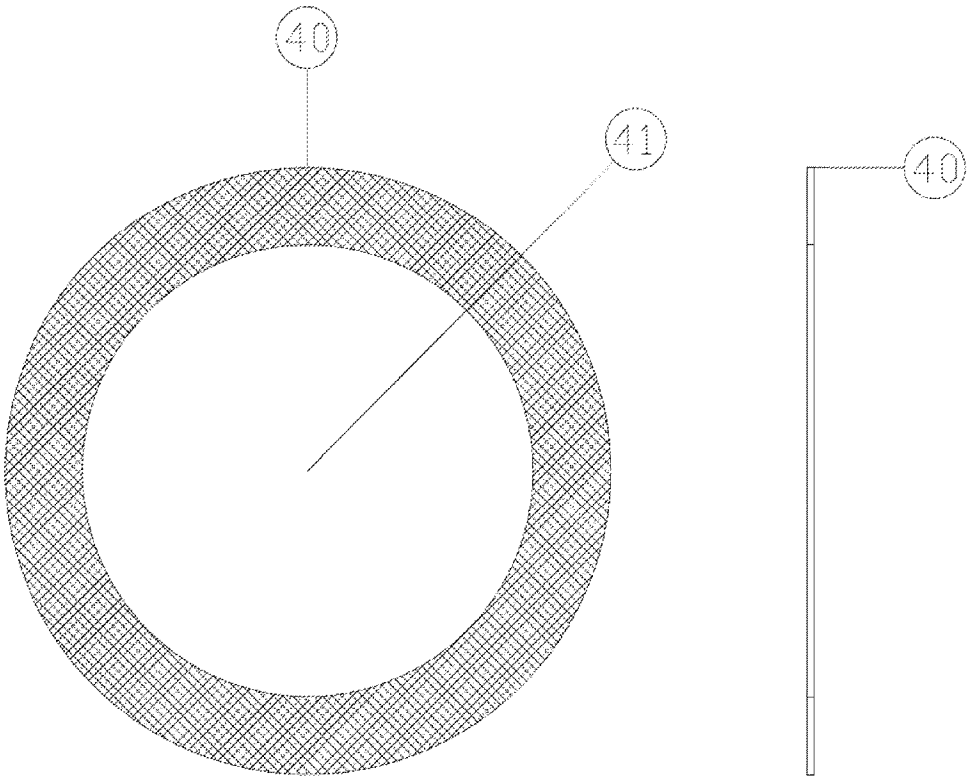
FIG. 5 is a plan view and side view of a gasket of the present invention.

In a preferred embodiment, the gasket 50 is about 1/16 to 1 inch thick, more preferably about 1/16 to 3/4 inch thick, more preferably, the gasket is about 1/8 to 1/2 inch thick, even more preferably about 1/8 to 1/4 inch thick, and most preferably about 1/8 inch thick. The gasket is illustrated in FIG. 5.

The rounded shape of the plate, either cathode plate 20 or anode plate 10, preferably has a diameter from about 1.5 inches to about 20 inches, more preferably about 4 inches to about 12 inches. Additionally, other diameter sizes, such as, but not limited to, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, and 19 inches are envisioned.

The production area 15 for the anode plate or the production area 25 of the cathode plate, is preferably located in the central portion of the rounded shape. Preferably, the anode plate and cathode plate comprise a first shaped cut-out at the top portion of the plate and a second shaped cut-out at the bottom portion of the plate, where the flat portions of each shaped cut-out are parallel to each other on the plate. The shaped cut-outs are preferably cut out of the plate such that the shaped cut-out portions create voids in the matrix of the plate. The production area is preferably the area in between the flat portions of the shaped cut-outs of the plate.

In a preferred embodiment, the cell plate production area, either anode plate 10 production area 15 or cathode plate 20 production area 25, can be calculated based on the diameter of the rounded portion 18 of the anode plate 10 or the rounded portion 28 of the cathode plate 20.

The production area can be calculated as follows:

Effective area=Area within the flange gasket−flow passage segment.

$$\text{Effective area}=\{Pi*r^2\}-\{(r^2)*(Pi/2\text{RAD}-\text{SIN } Pi/2)\}$$

Figure 9:
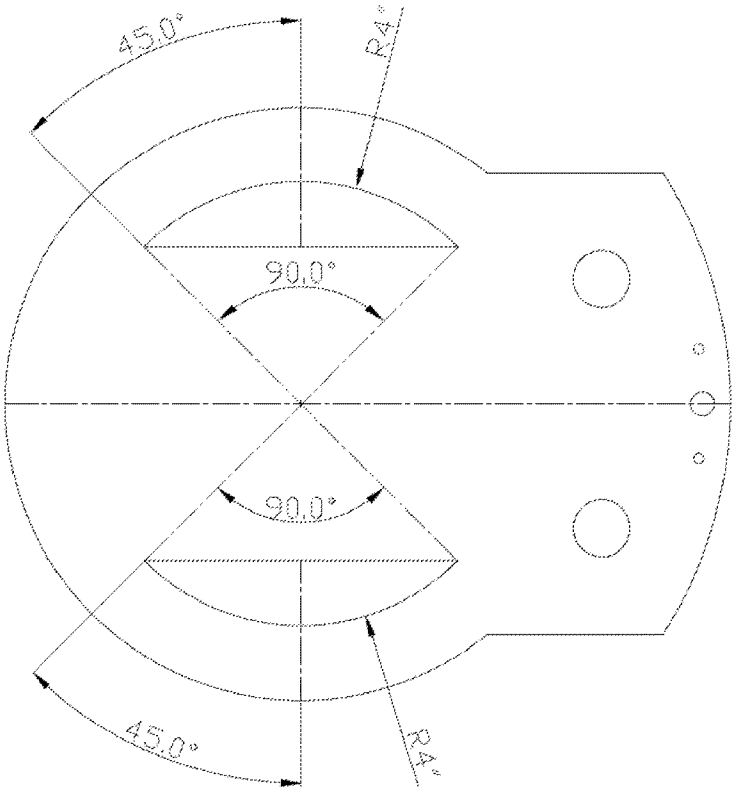
FIG. 9 is a plan view of either a cathode or anode plate showing the spacing of the shaped cut-outs.

The shaped cut-out portions 11 of the anode plate 10 and the shaped cut-out portions 21 of the cathode plate 20 are preferably sized according to the size and shape of the plate. In a preferred embodiment, if one drew a line from the corner of one side of the flat portion of the shaped cut-out of the first shaped cut-out portion to the corner of the opposite side of the flat portion of the second shaped cut-out portion and repeated this for the opposite corner of each shaped cut-out portion, forming an X, the interior angles of the X would preferably be about 90°. The interior angles of the X could also be 75°, 80°, 85°, 88°, 89°, 91°, 93°, 95°, 100°, or 105° angles. An embodiment where the interior angles are 90° is illustrated in FIG. 9. As a non-limiting example, if lines were drawn from the endpoints of one shaped cutout to the opposite endpoints of the second shaped cut-out so they create an "X" in the middle of the plate, the angle formed by the "X" beneath the shaped cut-out would preferably be 90 degrees. This angle could also be from 60 degrees to 120 degrees in any increment. Preferably, the ratio of the straight line segment of the shaped cut-out to the straight line distance between shaped cut-outs is 1:1. This ratio can be 0.577:1 to 1.73:1 in any increment. Preferably, the ratio of the height to width of the shaped cut-out portion is about 1:1, 1.5:1, 1:1.5, 1:2, or 1:3, with a 1:1 ratio being the most preferred.

The anode plate 10 and cathode plate 20 preferably each include a tab portion, 12 and 22 (respectively) that is stepped out from the diameter of the main portion of the plate. The tab portions 11 and 22, of the plates preferably provide a cooling effect as well as keeping the electric current attachment away from the production area of the plate to avoid heat transfer to the production area. The tab preferably comprises at least two, more preferably at least three apertures at the end portion of the tab, where preferably one of which is used to connect the power supply to the plate and the other two apertures are used as sensor connections. Additionally, the tab preferably comprises two large apertures to facilitate some of the bolts that secure the cell components into a single assembly. The end portion of the tab preferably extends outward from the plate in a rounded shape, such that the apex of the rounded shape of the tab provides a point that is away from the center of the production area. The cross-section size of the tab is preferably based on the amp density. In a preferred embodiment, the tab portion provides for the electrical connection. The cross section of the tab where the electrical connection attaches must have a certain density in order to allow the appropriate amount of current to enter the chlorine generating cell. Preferably, the current density of the cross-section of the tab is 250 amps/in$^2$, where this is a maximum amp density, meaning that any amperage less than 250 amps/in$^2$ will work for purposes of the present invention. The current density is limited by a current setting in the power supply that can be applied to the plates and the size (length and thickness) of the connection.

The chlorine generating cell of the present invention preferably includes a plurality of gaskets 50. In a preferred embodiment, a gasket is placed between each anode plate 10 and cathode plate 20 and between the cathode plate 20 and the inlet end plate 30 as well as between the cathode plate 20 and the outlet end plate 40. While an arrangement of the plates having anode plate 10, cathode plate 20, anode plate 10, would work, it is most preferred that there is one more cathode plate 20 in the system than anode plates 10 due to efficiency and the cost of producing the anode plates 10. As a non-limiting example of a chlorine generating cell utilizing 3 plates, there would be in succession: an end portion, a gasket, a cathode plate, a gasket, an anode plate, a gasket, a cathode plate, a gasket, and the second end portion. The gaskets are preferably ring shaped and are preferably sized appropriately to the size of the plates. Preferably, the gaskets provide a barrier on each side of the plates such that the plates do not contact each other. Additionally, the gaskets provide separation such that the brine solution can contact the plates in the production area creating free chlorine. In an embodiment where a circular plate is used, the gasket is preferably a circular ring. In an embodiment where an oval plate is used, the gasket is preferably an oval shaped ring. In an embodiment, where an ellipses is used, the gasket is preferably shaped as an ellipses ring. Preferred material for the gaskets is selected from the group consisting of, but not limited to, Viton, Buna-n, and EPDM, although other materials that do not conduct electricity are envisioned. The interior diameter of the gasket is preferably about 1.5 inches to about 20 inches, more preferably about 4 inches to about 12 inches. Additionally, other interior diameter sizes, such as, but not limited to, 2 inches, 3 inches, 4 inches, 5 inches, 6 inches, 7 inches, 8 inches, 9 inches, 10 inches, 11 inches, 12 inches, 13 inches, 14 inches, 15 inches, 16 inches, 17 inches, 18 inches, and 19 inches are envisioned. The interior diameter of the gasket is dependent on the diameter of the round portion of the plate. The gasket is preferably sized such that the interior edge of the gasket lines up exactly with the shaped cut-out portions, such that there is no lip of gasket that extends beyond the shaped cut-out into the void left by the shaped cut-out. If such a lip exists, it can become a low pressure zone capable of accumulating build-up and mineral deposits. The outer diameter of the gasket is preferably about 1-4 inches greater than the interior diameter of the gasket, where most preferably, the outer diameter of the gasket is 2¾ inches greater than the interior diameter of the gasket.

In a further embodiment of the present invention, the chlorine generating cell can be enclosed. The chlorine generating cell is preferably enclosed using a material that is non-conductive. Any non-conductive material will work for purposes of this embodiment, however, it is preferably PVC or some type of plastic or polymer. In such an embodiment, the inlet end plate and outlet end plate may either be separate from the enclosure or attached or molded to the enclosure forming composite piece serving as the inlet and outlet plate as well as the enclosure. The enclosure may have one or more apertures for liquid and/or gas to enter and exit the chlorine generating cell.

Figure 10:
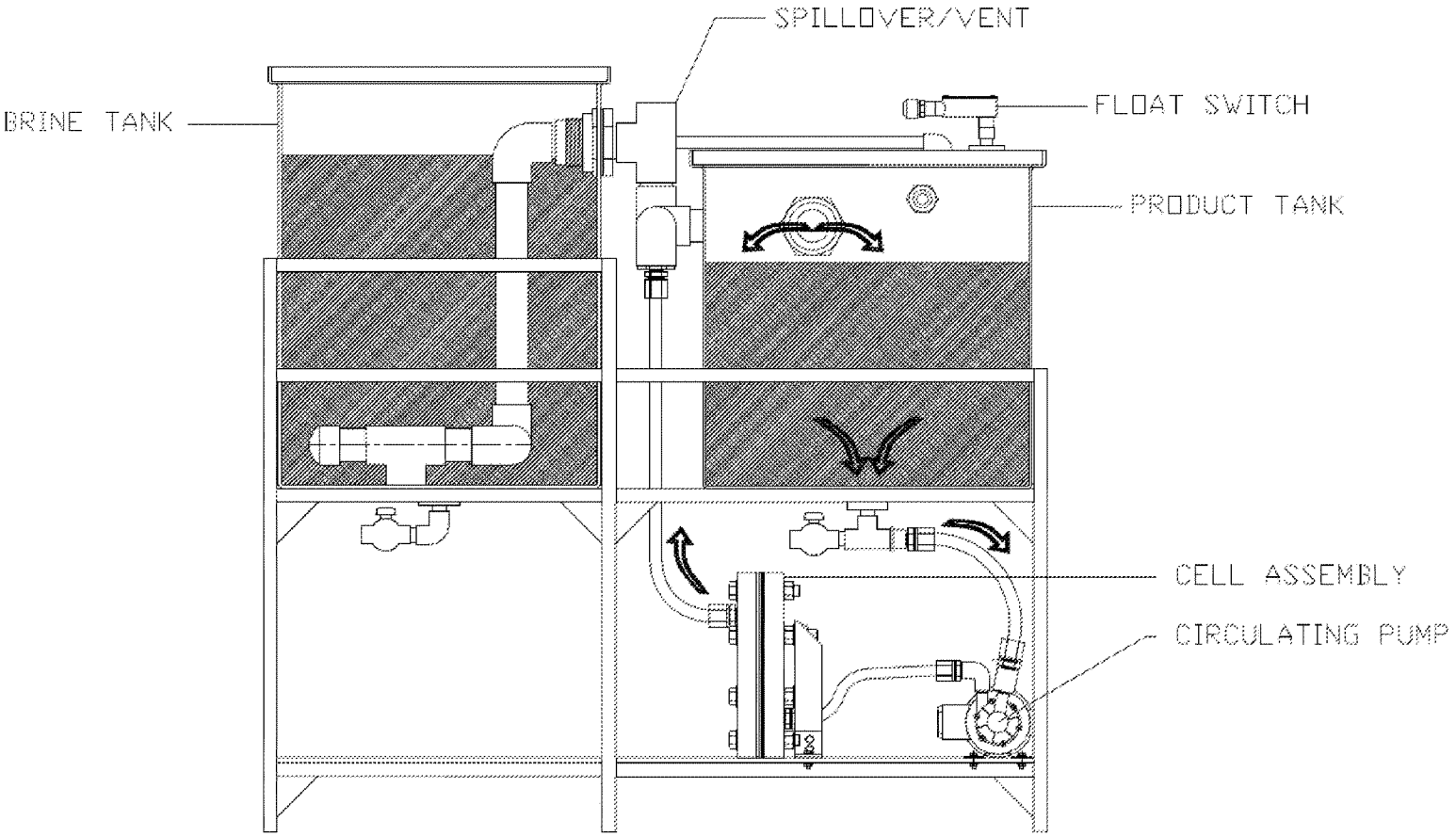
FIG. 10 is a side view of the chlorine generating cell of the present invention connected to a brine tank and product tank.

Preferably, the chlorine generating cell is attached to a brine tank at the inlet of the inlet end plate and attached to a product tank at the outlet of the outlet plate. An electric current is attached to each plate and the system is turned on such that voltage is running through the chlorine generating cell. The brine solution then enters the chlorine generating cell and the brine solution passes over the plates within the system in a uniform manner. As the brine solution pass over the electrolytic cell, a chemical reaction takes place. The reaction causes the chlorine that is found in the salt of the brine solution to re-combine with oxygen and the sodium to form sodium hypochlorite. FIG. 10 illustrates the chlorine generating cell attached to a brine tank and product tank.

Preferably, the contents of the product tank (which can be an R/A tank, however this is not required) or the tank that holds the hypochlorite is continually pumped through the cell to build the concentration up to a minimum of 0.8% (8000 PPM). When this concentration is reached, typically after 5 hours of run time, but not limited to this time period, the hypochlorite is then ready for use. As the hypochlorite is used from this tank, the contents are replenished with the proper concentration of brine. Because the brine solution is continually being pumped through the chlorine generating cell, the strength of the solution is able to be maintained preferably at a level close to the typical 0.8%.

The chlorine generating cell preferably provides a means for liquid to flow in and out of the system. The velocity of the fluid through the cell assembly is preferably 150 ft./min. to 190 ft./min. with the preferred velocity around 170 ft./min. This has been shown to achieve good gas removal from the surface of the plates and good cooling effects for the plates. Preferably, the chlorine generating cell of the present invention operates at a temperature of from about 65° F. to about 175° F., more preferably from about 70° F. to about 150° F., more preferably from about 70° F. to about 120° F., still more preferably, from about 70° F. to about 100° F., and most preferably from about 70° F. to about 90° F.

In a preferred embodiment, the present invention provides a method of generating free chlorine using the chlorine generating cell of the present invention. The method preferably includes the steps of running a brine solution through the chlorine generating cell of the present invention. The salt concentration of the brine determines the amount of free chlorine that can be produced by the system. Preferably, the brine has a salt concentration of about 2% to 26%, where ranges such as 3% to 10%, 3% to 15%, 2% to 8%, 2% to 6%, 10% to 15%, 11% to 16%, 3% to 13%, 4% to 13%, 5% to 13%, 6% to 13%, 7% to 13%, 8% to 13%, 9% to 13%, 10% to 13%, 11% to 13%, 12% to 13%, with a salt concentration of less than 13% being the most preferred. The chlorine production rate is based on the salt concentration of the brine solution. For example, if a 2% salt concentration brine solution is used, the maximum chlorine concentration is about 9000 parts per million (ppm), with a chlorine production rate of 9396 ppm/in$^2$/day/gallon. The preferred chlorine production amounts are provided in Example 1. Preferably, the chlorine generating cell of the present invention produces from about 9,000 ppm/in$^2$/day/gal. to about 38,000 ppm/in$^2$/day/gal, where values such as 10,000 ppm/in2/day/gal to 30,000/in2/day/gal, 15,000/in$^2$/day/gal to 25,000/in$^2$/ day/gal, and all values in-between are envisioned. In another embodiment, the brine solution contains 13% or less salt, meaning that the amount of chlorine produced in a day is about 38,000 ppm/in$^2$/day/gal or less.

Preferably, the salt usage in the chlorine generating cell of the present invention is generally affected by the following: a) pounds of salt per gallon of brine at any given concentration (Lbs./gall); b) the required chlorine production rate (Lbs. Cl/day); c) brine concentration (%); and d) the maximum chlorine concentration at desired brine concentration (PPM). The following formula can be used to determine the salt usage:

Avg. # of salt/# of Cl produced=(0.0974*salinity (%))+3.6727

Preferably, the size of the product tank utilized in connection with the chlorine generating cell of the present invention is affected by the required pounds of chlorine per day and the maximum chlorine concentration attainable based on 3% salinity in the product tank to produce an hold the required pounds of chlorine per day. The size of the tank is preferably determined using the following formula:

Product tank capacity(Gal.)=[Required Cl production (Lbs. Cl/day)]*[120,000(PPM/Lbs. Cl/day/gal.)]/[Concentration limit(10,900 PPM)]

As non-limiting example:
5 Lbs. Cl/day required.

The determination of the size of the tank to be used is considering that no liquid is removed from the tank by evaporation or use. The volume of the system piping has been ignored as well. The actual tank size may be the next available size smaller than the capacity determined above depending on the amount of liquid removed from the tank or system piping.

Generally, the amount of chlorine produced per day will be used during and exhausted during a 24 hour period. The volume of the product tank would, therefore, have to be replaced every 24 hours. In an embodiment, where the product tank was emptied and refilled after reaching the maximum concentration, at least once per day, there would be a minimum of two product tank volumes used during a 24 hour period. In this embodiment, the tank volume can be safely reduced by one-half from what was determined above due to the fact that the liquid within the tank is emptied at least one per day or a volume of liquid equal to the tank size is recirculated at least once per day. The formula for the actual product tank size can be determined as follows:

Actual Product tank capacity(Gal.)=Product tank capacity(Gal.)/(1+# of fills per day)

The brine tank size used is affected by the amount of brine utilized and the desired fill interval of the brine tank. Preferably, the brine tank size is determined using the following formula:

Brine usage(Gal./batch)=[pounds of salt per gallon at predetermined Product tank salinity (Lbs./gal.)]/[2.601 (Lbs./gal.)]*[Product tank volume (Gal.)]

Preferably, the chlorine generating cell of the present invention allows gas created within the chlorine generating cell to exit the system without building up. Preferably, at least 90% of the gas within the system exits, more preferably, at least 95% of the gas within the system escapes, and most preferably 99% to 100% of the gas within the system exits. This is advantageous as gas accumulation leads to extreme temperatures and potential explosions within chlorine generating systems generally. Thus, the chlorine generating cell of the present invention is surprisingly safe. Preferably, the temperature within the chlorine generating cell is between 70° F. and 90° F.

Definitions

A "brine solution" for purposes of the present invention refers to a solution of salt in water. This includes, but is not limited to, manufactured salt solutions and naturally occurring salt water. Preferably, the salt in the brine solution is sodium chlorine; however, the term "brine solution" is not so limited for purposes of the present invention. Further, the brine solution of the present invention can have any salinity, where the appropriate salinity may be configured using the "Sodium Chloride Brine Tables for Brine at 60° F." produced by Morton Salt Company (Chicago, Ill.), which is incorporated herein by reference.

"Pi" refers to a constant used in geometric calculations, equal to 3.1416 . . . .

"RAD," as used herein, refers to an abbreviation for radians, an angular measurement used in formulas where 2*Pi radians equal 360 degrees, so Pi/2 radians equal 90 degrees.

"SIN," as used herein, is the abbreviation for the trigonometric function of the sine of an angle, the angle being expressed in radians.

For purposes of the present invention a "shaped cut-out" or "shaped cut-out portion" refers to portions of the anode or cathode plate which create a void within the plate. The shaped cut-out can be any shape which provides one apex down the center line of the shape. Examples of such shaped cut-outs, include, but are not limited to, a crescent, a half moon, a half circle, a triangle, a diamond, a hexagon, a half-hexagon, a circle, a half-circle, an oval, a half-oval, an ellipses, and a half-ellipses.

"Plenum," for purposes of the present invention refers to a space or volume where material is able to collect into and then be distributed out of and evenly into multiple exit avenues. This plenum is preferably refers to the shaped cut-outs in the anode or cathode plate, The "effective area" for purposes of the present invention refers to the actual production area of the cell plate.

The "product tank" as used herein, refers to the tank that holds the chlorine solution created by the chlorine generating cell of the present invention. One type of product tank is an Product tank, which stands for recirculating/accumulating tank, however, the present invention is not limited to this embodiment, as any tank that holds the chlorine solution generated by the cell of the present invention will work.

EXAMPLES

Example 1

This example illustrates the chlorine production rates depending on the size of the plate utilized in the chlorine generating cell.

Materials and Methods:

Brine solutions having different concentrations of salt were introduced into a chlorine generating cell of the present invention having a variety of plate sizes to determine the chlorine production from the chlorine generating cell.

Results and Conclusions:

Based on information of the production rate of the four inch cell at 3%, 7%, 10%, 13%, 16%, and 20% salinities, and 7.5 gallon system capacity, the pounds of chlorine produced per day rate may be determined.

Since 120,000 PPM of chlorine in one gallon of solution equates to one pound of free and combined chlorine (120,000 PPM-Gal.=1 Lbs. Cl), a system that is 7.5 gallons would require {120,000 PPM-Gal./Lbs. Cl}/{7.5 gal.} or 16,000 PPM of chlorine to equal 1 pound of free and combined chlorine. If the Product tank were large enough so the chlorine concentration ($C_{max}$) peaked at 24 hours of run time instead of $T_{MAX}$ running hours, the chlorine produced would be [($C_{max}$ PPM)*(24 hrs./$T_{MAX}$ hrs.)]/16,000 PPM/day. By using this daily rate and the cell area, the daily production per square inch of cell area may be determined for different salinities.

Example 2

This example illustrates how the flow rate within the chlorine generating cell of the present invention was determined.

Materials and Methods:

The tested system ran with the original 4" cell design, had a measured flow rate of 3.3 GPM. Based on this and the configuration of the cell, we compiled different flow rates for the different size of the cell plates. The flow rates complied below are for a single flow passage. If there is a multiple pass cell, the flow rate should be multiplied by the number of flow passages.

The two criteria are: basing the GPM on flow per IN.$^2$ of effective cell area or basing it on the velocity of the fluid passing over the cell face. The method of a constant velocity along the cell face yields a higher flow for cells less than 4 inch. The alternate method of basing the flow on the GPM/in$^2$ yields more flow for cells above four inch. Pumps are sized using the velocity criteria.

Results and Conclusions:

One inch cell—

Flow based on rate per unit area=0.21 GPM.

One & one-half inch cell—

Flow based on rate per unit area=0.46 GPM.

Two inch cell—

Flow based on rate per unit area=0.82 GPM.

Three inch cell—

Flow based on rate per unit area=1.85 GPM.

Four inch cell—tested cell

Flow based on velocity=3.3 GPM (

Six inch cell—

Flow based on rate per unit area=7.08 GPM.

Eight inch cell—

Flow based on rate per unit area=13.16 GPM.

Twelve inch cell—

Flow based on rate per unit area=29.6 GPM.

The flow criteria between the plates will be based on the velocity of the solution moving through the passages between the plates. The flow rate determined by these criteria is shown in bold for each size of plate.

Daily production rate(@% salinity)=Effective area*Rate per unit area for given salinity The cell is sized by knowing the following:

1. Daily volume of water to be disinfected in gallons.
2. The PPM of chlorine the waste stream has dosed with.
3. The number of hours the generator will be operating per day.
4. A minimum of 3% salinity in the product tank. This salinity has a chlorine production rate of 14040 PPM/day/in$^2$/gal. per Table 1.

By looking at the effective area of the different cell configurations disclosed herein, it is found that a six inch, single passage cell is required to do this.

Example 3

This example provides the optimal power supply for chlorine production based on the percentage of salt in the brine solution.

Materials and Methods

Based on an average amp draw per square inch of effective area (from testing) at 3%, 7%, 10%, 13%, 16%, & 20% salinities and 5.0 DC volts applied to the plates, the total current draw could be determined for each size of cell plates.

Power supply will be sized for salinity of 13%. It was found by testing, that the maximum chlorine concentration produced at salinities above 13% was no greater than that produced at 13%.

To achieve a 5 VDC supply at the cells, a 6.7 VAC supply was required at the rectifier.

Results and Conclusions

3%—2.89 Amps/in$^2$ effective cell area

7%—4.88 Amps/in$^2$ effective cell area.

10%—7.04 Amps/in$^2$ effective cell area.

13%—8.13 Amps/in$^2$ effective cell area.

16%—9.78 Amps/in$^2$ effective cell area.

20%—10.81 Amps/in$^2$ effective cell area.

Example 4

This example provides for determining the amount of salt needed per day in the chlorine generating cell of the present invention.

Materials and Methods:

The factors that affect salt usage are:

1. Pounds of salt per gallon of brine at given concentration (Lbs./gal.)
2. The required chlorine production rate (Lbs. Cl/day).
3. Brine concentration (%).
4. Maximum chlorine concentration at desired brine concentration (PPM).

How many pounds of salt will a 5 Lbs./day generator use with 8% brine solution in the R/A tank?

=(Lbs. salt/gal. brine at 8% conc.)*[(daily Cl prod.)*(120,000 PPM/#Cl/gal.)/Max. Cl conc.)]

=(0.706 Lbs./gal.)*[(5#Cl/day.)*(120,000 PPM/#Cl/gal.)/(17,900 PPM)]

=23.7Lbs. salt/batch Cl.

The invention claimed is:

1. A chlorine generating cell comprising:

a) at least one anode plate having at least one shaped cut-out portion therein;

b) at least one cathode plate having at least one shaped cut-out portion therein;

c) at least three gaskets;

d) an inlet of a brine solution; and e) an exit of a chlorine solution;

wherein the at least one anode and the at least one cathode each have a production area located in the central portion of the at least one cathode or the at least one anode, wherein the production area is above a cutout portion of the cathode and anode plates; and wherein the anode plate and the cathode plate are the same shape.

2. The chlorine generating cell of claim 1, wherein the chlorine generating cell further comprises two end plates.

3. The chlorine generating cell of claim 1, wherein there is one anode plate having at least one shaped cut-out portion and two cathode plates having at least two shaped cut-outs therein.

4. The chlorine generating cell of claim 3, further comprising two end plates, where one is an inlet end plate and one is an outlet end plate.

5. The chlorine generating cell of claim 4, wherein the chlorine generating cell is arranged as inlet in plate, gasket, cathode plate, gasket, anode plate, gasket, cathode plate, gasket, and outlet end plate.

6. The chlorine generating cell of claim 1, wherein the cathode plate and anode plate each have a rounded shape with a tab portion extending therefrom.

7. The chlorine generating cell of claim 6, wherein the tab portion comprises a plurality of apertures.

8. The chlorine generating cell of claim 7, wherein the plurality of apertures provide for an electrical connection to the cathode plate or anode plate.

9. A plate for use in a chlorine generating cell, comprising a material having a rounded shape with a tab portion, where the rounded portion comprises one or more shaped cut-outs and a production area, wherein the tab portion includes at least four apertures, and wherein the production area is located in a central portion of the plate.

10. The plate of claim 9, wherein the plate is a cathode plate.

11. The plate of claim 9, wherein the plate is an anode plate.

12. The plate of claim 9, wherein the plate is made of titanium.

13. The plate of claim 9, having a plenum.

14. The plate of claim 9, wherein the one or more shaped cut-outs are crescent shaped.

15. The plate of claim 9, wherein the tab portion comprises a plurality of apertures.

16. The plate of claim 15, wherein the apertures are used to connect an electrical source, one or more sensors, and connect the plate to a chlorine generating cell.

17. A method of producing chlorine comprising the steps of a) connecting the chlorine generating cell of claim 1 having at least one inlet and at least one outlet to a first tank;

b) connecting the chlorine generating cell of claim 1 to a second tank at the outlet;

c) placing a brine solution in the first tank;

d) connecting an electrical source to the chlorine generating cell;

e) allowing the brine solution to run through the chlorine generating cell; and f) collecting free chlorine in the second tank.

* * * * *